United States Patent [19]

Marks et al.

[11] Patent Number: 4,960,394

[45] Date of Patent: Oct. 2, 1990

[54] GROOMING RING AND GROOMING RING CARRIER

[75] Inventors: Robert J. Marks, Carpentersville; Albert Kupferschmidt, Highland Park, both of Ill.

[73] Assignee: Northern Telecom Limited, Montreal, Canada

[21] Appl. No.: 397,956

[22] Filed: Aug. 23, 1989

[51] Int. Cl.[5] ..... H01R 9/24

[52] U.S. Cl. ..... 439/719; 264/318; 264/328.1

[58] Field of Search ..... 379/328; 174/72 A; 361/426, 428; 439/708, 709, 712, 713, 717, 719, 722, 723, 725, 736; 425/DIG. 5; 264/318, 328.1, 328.16

[56] References Cited

U.S. PATENT DOCUMENTS 4,002,856 1/1977 Sedlacek et al. ..... 379/327

4,194,804 3/1980 Vinch et al. ..... 439/719

*Primary Examiner*—Eugene F. Desmond

*Assistant Examiner*—Walter G. Hanchuk

*Attorney, Agent, or Firm*—Foley & Lardner, Schwartz, Jeffery, Schwaab, Mack, Blumenthal & Evans

[57] ABSTRACT

A grooming ring on a grooming ring carrier in which the grooming ring extends around a grooming space while being displaced axially to enable all surfaces of the ring to be free of obstruction in at least one direction laterally of a surface of the carrier from which the ring extends. This allows for simultaneous molding of carrier and ring without a mold core for forming the grooming space. In practice, the ring may be formed from two ring portions which are displaced axially relative to each other. The grooming ring carrier may be either a fanning strip or a terminal block.

8 Claims, 5 Drawing Sheets

GROOMING RING AND GROOMING RING CARRIER

This invention relates to grooming rings and grooming ring carriers.

Terminal blocks are known having many mounting positions for providing terminal connections between individually insulated electrical conductor wires. It is normal for such blocks to be provided with rings (referred to normally as "grooming rings") which extend outwardly beyond an edge surface of a respective block for retaining or corralling a group of conductors together in a controlled manner as they extend along the edge of the block to the mounting positions. The grooming rings may be formed from plastic and have openings which open upon resilient movement of parts of the rings to allow for lateral movement of electrical conductor wires through the openings and into grooming spaces within the rings. Resilience of the ring parts normally maintains the lateral openings sufficiently closed together to resist or prevent conductor wire removal from within a grooming space. Such rings are made separately from the terminal blocks and may be detachably mounted upon the terminal blocks (which thus provide carriers for the rings) by connecting the rings to a metal clip which is then mounted upon the block. Alternatively, a carrier is provided by a fanning strip. Fanning strips have fanning projections which guide selected conductor wires between them as the wires proceed from their controlled group to their respective mounting positions. Carrier rings are normally assembled to fanning strips in a manner similar to assembly to terminal blocks.

With conventional grooming ring and carrier configurations, molding of the rings and carriers as integral units is not practiced. This is, at least in part, due to the fact that a simple two part mold cannot be used. A two part mold may easily mold two sides of a carrier. However, the incorporation of an integral grooming ring requires the use of a third mold part in the form of a mold core. This mold core is movable transversely to the direction of movement of the other mold parts for the purpose of defining the inside surface of the grooming ring and hence the grooming space which has an axis extending longitudinally of the edge surface. Thus, a more complex and intricately operating mold, together with inherent added expense, would result.

It would, however, be extremely convenient if a grooming ring could be molded integrally with its carrier by the use of a simple molding operation while avoiding the necessity for the use of a mold core moving in its own individual direction for the grooming space within the ring. The present invention seeks to provide a carrier and grooming ring which are integrally molded together and which may be formed by a simple molding operation, i.e., by avoiding a mold core moving in a direction different from that followed by other mold parts.

Accordingly, the present invention provides an integrally molded grooming ring and grooming ring carrier in which the carrier has one side surface with a longitudinally extending axis and the grooming ring projects from the carrier outwardly beyond said side surface and extend laterally of the side surface to define a grooming space having an axis extending longitudinally of the side surface, the grooming ring being resiliently flexible from a normal relaxed state to widen a gap for passage therethrough of conductors into the grooming space, and, in the normal relaxed state, the grooming ring being displaced axially of the side surface as it extends around the grooming space to enable all surfaces of the grooming ring at any position along those surfaces, to be free of obstruction in at least one direction across the side surface and normal to its longitudinal axis.

With the above structure according to the invention, while the grooming ring has an axis extending longitudinally of the side surface, no mold core is required for forming the grooming space, because all grooming ring surfaces may be molded by mold parts movable together and apart in a direction laterally of and across the side surface. These mold parts could also mold other parts of the carrier. Thus, the molding operation of the integral grooming ring and carrier may be performed simply upon a mold having two mold parts which are movable into and out of mold cavity forming positions.

In structures according to the invention, the grooming ring may be a one piece ring. However, the ring is alternatively formed in two portions.

Accordingly, the present invention also includes according to another aspect, an integrally molded grooming ring and grooming ring carrier in which the carrier has one side surface with a longitudinally extending axis and a grooming ring projects from the carrier outwardly beyond said side surface and extends laterally of the side surface to define a grooming space having an axis extending longitudinally of the side surface, the grooming ring comprising two ring portions having ends integrally molded with the carrier and extending to free ends which, in a normal relaxed state of the ring portions, lie adjacent one another, the ring portions being resiliently movable by resilient flexing of at least one ring portion to widen a gap between their free ends for passage of conductors therebetween and into the ring and, in the normal relaxed state, the ring portions are displaced relative to one another axially of the side surface with all surfaces of the ring portions, at any position along those surfaces, being free of obstruction, in at least one direction across the side surface and normal to its longitudinal axis.

In structures according to the invention, the carrier may be a fanning strip which is for attachment to a terminal block or the carrier may be the whole of a terminal block itself. In the case where the carrier is a fanning strip then on another side of the fanning strip remote from the side surface from which the grooming ring extends, the fanning strip is preferably formed with mounting means to enable the strip to be assembled onto a terminal block.

The invention also includes a method of integrally molding a grooming ring and grooming ring carrier in which the carrier has a side surface with a longitudinally extending axis and the grooming ring projects from the carrier outwardly beyond said side surface while extending laterally of the side surface to define a grooming space having an axis extending longitudinally of the side surface, said method comprising: moving mold parts together in opposite directions to define a mold cavity, the directional movement of the mold parts being laterally of the longitudinally extending axis; integrally molding the grooming ring and carrier within the mold cavity with the grooming ring being displaced axially of the side surface as it extends around the grooming space with said mold parts defining all surfaces of the ring and also forming the grooming space; and opening the mold by moving the mold parts away from each other in a direction normal to the longitudinal axis of the side surface and transversely of the axis of the grooming space, all surfaces of the ring, at any position along those surfaces, being free of obstruction in at least one direction across the side surface and normal to its longitudinal axis.

Embodiments of the invention will now be described, by way of example, with reference to the accompanying drawings, in which.

Figure 14:
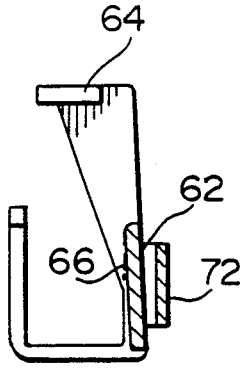
Figure 13:
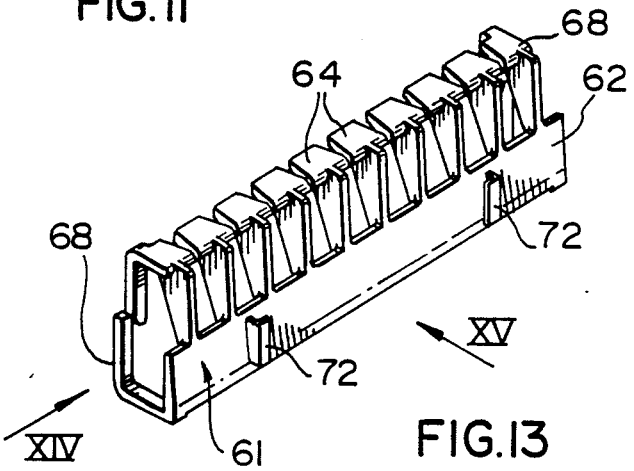
Figure 16:
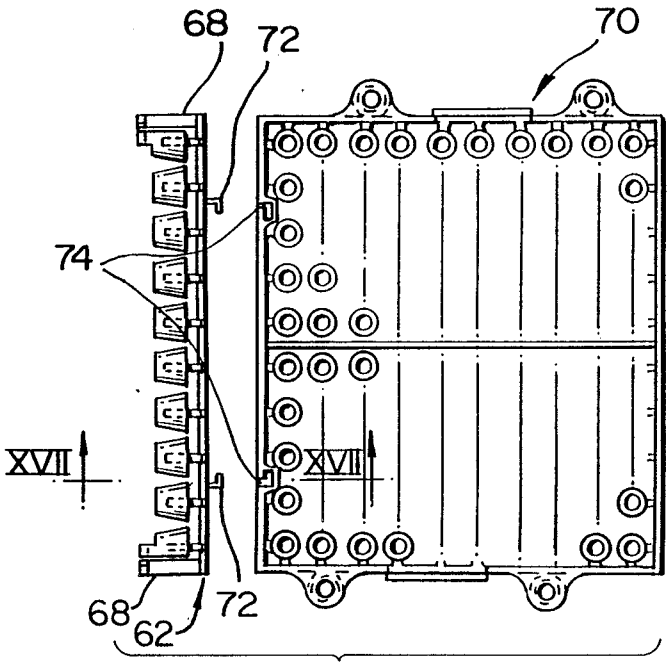
Figure 15:
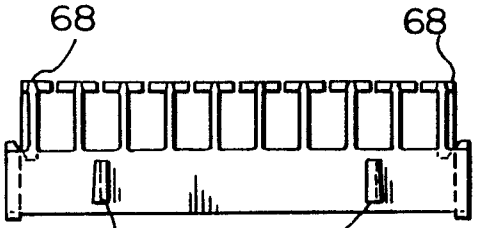
Figure 17:
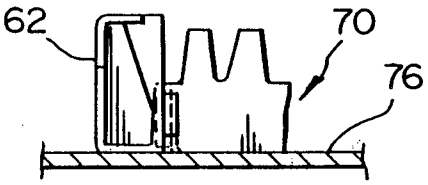

FIG. 13 relating to a third embodiment of the invention, is an isometric view of a fanning strip having integral grooming rings;

FIG. 14 is a view, partly in section, in the direction of arrow XIV in FIG. 13 and to a larger scale;

FIG. 15 is a view of the fanning strip in the direction of arrow XV in FIG. 13;

FIG. 16 is a plan view, to a smaller scale, showing the fanning strip of the third embodiment located alongside a terminal block for mounting thereon; and FIG. 17 is a cross-sectional view taken along line XVII—XVII in FIG. 16, and to a larger scale, showing the fanning strip and terminal block after assembly.

Figure 1:
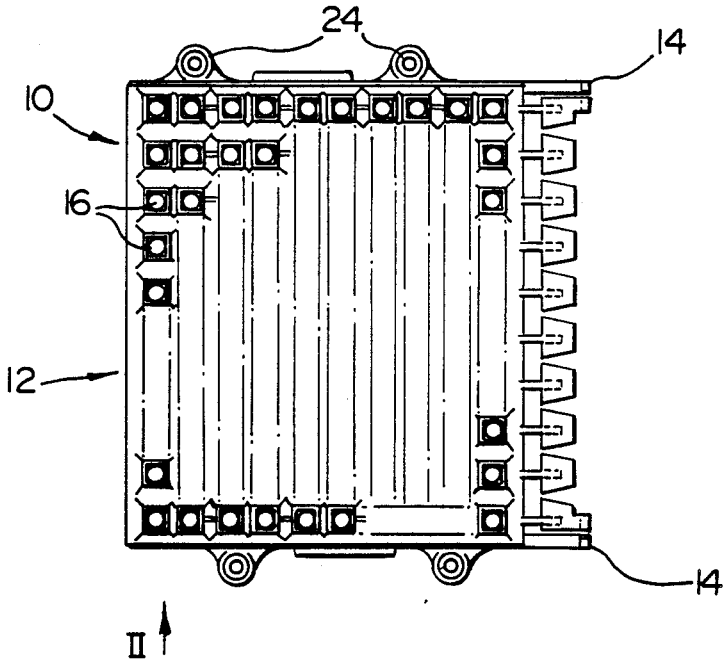
FIG. 1 is a plan view of a terminal block integrally carrying a fanning strip and grooming ring arrangement.
Figure 2:
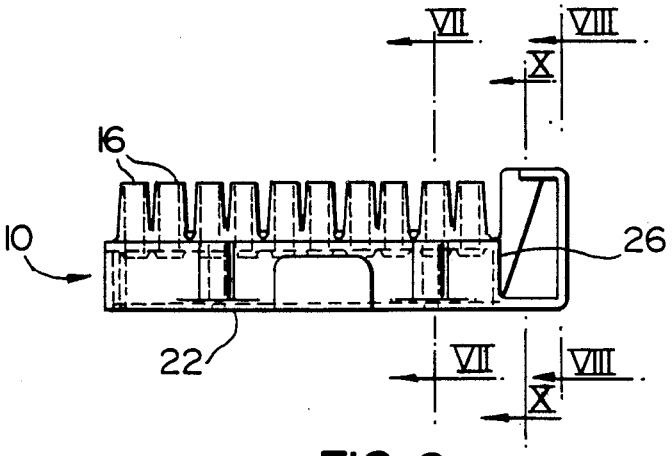
FIG. 2 is a view of the terminal block of FIG. 1 in the direction of arrow II in FIG. 1.

As shown in FIGS. 1 and 2, in a single integral molding 10, a terminal block 12 forms a grooming ring carrier for two grooming rings 14 disposed in axial alignment at opposite ends at one side surface of the terminal block.

As is shown in FIGS. 1, 2, 3 and 4, the terminal block is of rectangular shape in plan and has a plurality of terminal posts 16 for mounting terminal post inserts 18 (FIG. 3) for holding terminal screws 20 into the terminal block for the purpose of electrically connecting insulated conductor wires together. The posts 16 extend from a first side of the terminal block as shown clearly in FIGS. 2 and 3. A second side of the terminal block is provided by a flat surface 22 of the block for engaging a corresponding flat surface of a terminal block housing (not shown) for mounting the terminal block in position during use. At two opposite longitudinal side edges, as shown in FIG. 1, four mounting positions 24 are shown for passage of mounting screws for mounting the block into the terminal block housing.

Figure 5:
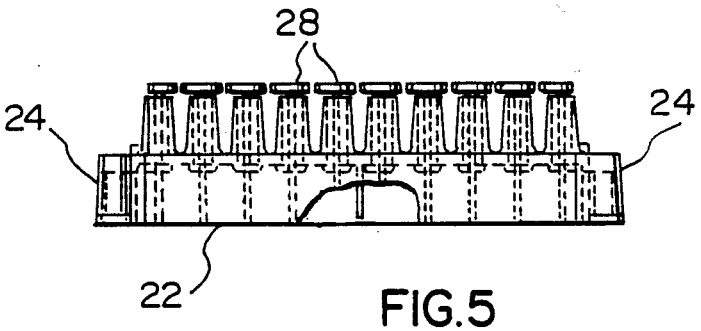
FIG. 5 is a side elevational view of the terminal block in the direction of arrow V in FIG. 4, while omitting the group of conductor wires.

As may be seen from the figures, the two grooming rings lie at opposite ends of a fanning strip which extends along a longitudinal side edge 26 of the block, the fanning strip comprising a plurality of fanning projections 28 which are spaced apart (FIG. 5) for the purpose of guiding selected electrical conductors between the projections and to specific terminal post inserts 18 and their corresponding terminal screws 20. In use, (FIG. 4) a group 30 of insulated electrical conductor wires passes through a grooming ring and longitudinally of the side edge 26 of the terminal block, the grooming ring controlling the position of the wires as they are selectively passed between fanning projections 28 to their respective terminal post inserts 18.

The fanning projections 28 are integrally formed with the terminal block 12. The grooming rings 14 are also integrally formed with the block, the design of the grooming rings allowing for a simple molding operation without any need for providing a separate mold core passing in an axial direction through the grooming rings. To allow for this simple molding operation while providing integral grooming rings and terminal block, each grooming ring 14 (FIG. 3) comprises two resiliently flexible ring portions 32 and 34 which extend outwardly from the surface of the side 26 of the block. Each ring portion has an end which is integrally molded with the carrier. The ring portions 32 and 34 extend around and define a grooming ring space 36 which has an axis extending longitudinally of the side 26. The ring portion 34 has a configuration at its integral end with the block which is similar to that of the fanning projections 28.

At positions spaced from the side 26 of the mounting block, the ring portions have legs 38 which turn towards each other so as to complete the ring and encompass the grooming space 36. The two ring portions 32 and 34 are displaced relative to one another in the longitudinal direction of the side 26 (FIG. 3) from fixed ends to free ends 40 of the ring portions. Thus, all surfaces of the ring portions, at any position along those surfaces are completely unobstructed in a direction across the side surface 26 and normal to the longitudinal direction of the surface 26. In particular, inner surface 42 of the ring portion 32 is completely free of obstruction from the first side of the terminal block (i.e., with the posts 16) so that a mold part is free to move in a direction normal to the longitudinal axis of surface 26 to mold the surface 40. Similarly, the inner surface of the ring portion 34 is free of obstruction from the second side of the block (i.e., that with flat surface 22).

Figure 3:
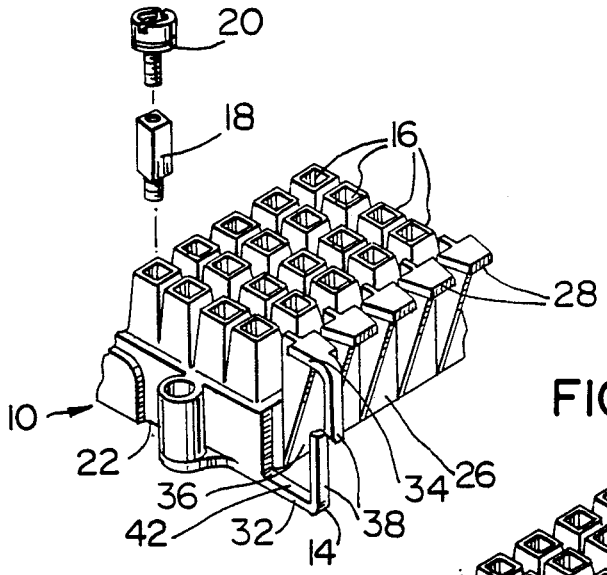
FIG. 3 is an isometric view of one corner region of the terminal block.
Figure 4:
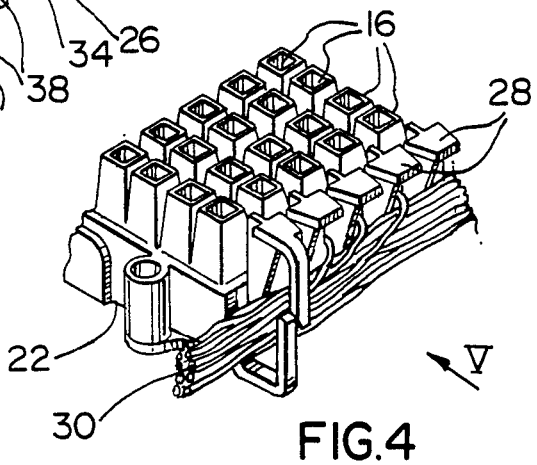
FIG. 4 is a view similar to FIG. 3 and showing a group of insulated electrical conductor wires passing through a grooming ring integral with the terminal block.
Figure 6:
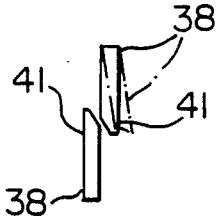
FIG. 6 is an elevational view of a detail of the grooming ring.

The free ends 40 of legs 38 are inclined and axially displaced relative to each other (FIGS. 3 and 6). The two ring portions 32 and 34 in a normal relaxed state have their free ends 41 adjacent to one another with a small gap between them, the small gap being insufficient for the passage of any of the conductor wires of the group 30. However, for the purpose of inserting one or more conductor wires into the grooming ring space, it is simply necessary to resiliently flex one or both of the ring portions 32 and 34 laterally, as shown for example in the dotted chain outline in FIG. 6, so as to widen the gap between the ends thereby allowing for passage of the wires. The legs 38 of the grooming ring portions then resiliently return to their normal relaxed conditions.

Figure 7:
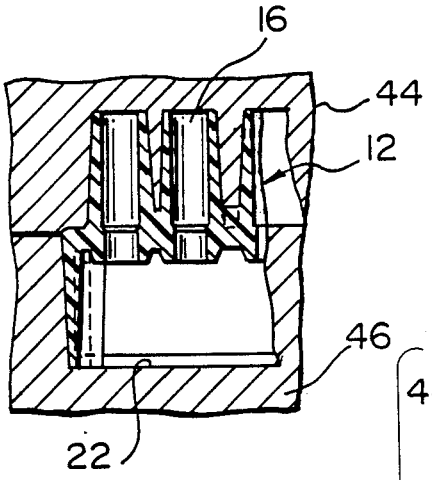
FIG. 7 is a cross-sectional view through the block along line VII—VII in FIG. 2 during a molding operation.

The structure of the first embodiment is integrally formed by a simple molding operation comprising two mold parts. As shown by FIG. 7, which illustrates a part of a mold for molding the terminal block 12, an upper mold part 44 and a lower mold part 46 are closed together to define a mold cavity for the integral assembly. The one mold part 44 has cavity portions for forming the terminal posts 16 of the terminal block while the other mold part 46 defines the second side of the block having the planar surface 22. Clearly these two mold parts are movable, as viewed in FIG. 7, vertically towards and away from one another for molding and releasing the terminal block 12.

Figure 8:
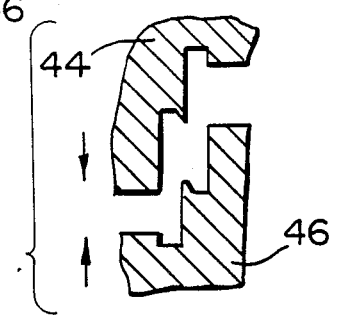
FIGS. 8 and 9 show mold parts for molding the grooming ring, the figures respectively, showing the mold in open and closed positions, and taken along line VIII—VIII in FIG. 2.
Figure 9:
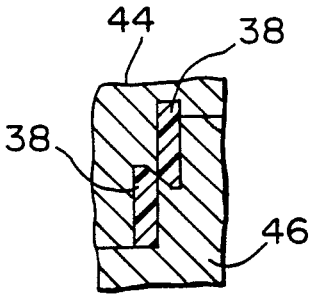

In addition, the two mold parts 44 and 46 mold the fanning strips and the grooming rings integral with the terminal block. As shown by FIG. 8, in the region for molding each grooming ring, the two mold parts 44 and 46 move towards each other to define cavity portions for providing the two axially displaced ring portions 32 and 34. In FIG. 9, the two mold parts 44 and 46 are closed together with the two legs 38 of the ring portions in molded form within their cavity portions. Similarly, in FIG. 10, the two mold parts 44 and 46 cooperate to define mold cavity portions for the remainder of the ring portions 32 and 34 towards the terminal block itself. Design of the mold parts is such that as they close together they meet along an interface 48 which lies transverse to the axis of each grooming space between the ring portions 32 and 34 so that the mold parts completely occupy the area of the ring which provides the grooming space. It follows that after molding, the two mold parts 44 and 46 are moved apart in a direction normal to the general plane of the terminal block to release the integral molding. In particular, the mold parts move apart in a direction normal to the longitudinal axis of the side 26, to release the two ring portions 32 and 34.

As can be seen from the above embodiment, because each grooming ring is axially displaced to expose all ring surfaces from one lateral edge or the other of the side 26, a separate individual core movable axially of the ring for forming the grooming space is avoided.

Figure 10:
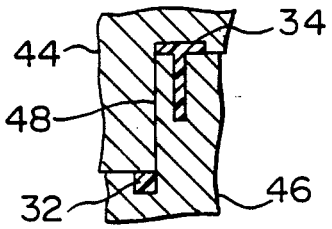
FIG. 10 is a cross-sectional view through the closed mold taken along line X—X in FIG. 2.
Figure 11:
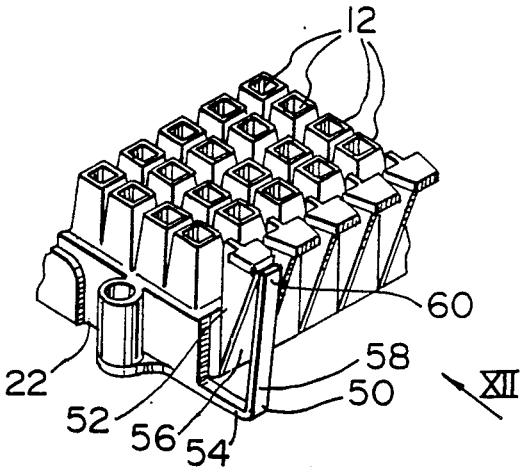
FIG. 11 is a view similar to FIG. 3 and showing a second embodiment of the invention.
Figure 12:
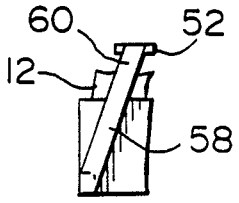
FIG. 12 is a detailed view of the second embodiment in the direction of arrow XII in FIG. 11.

In a second embodiment as illustrated in FIGS. 11 and 12, it is shown that it is not necessary to have each of the ring portions extending entirely in a plane normal to the axis of the grooming ring space. In the structure of FIGS. 10 and 11 in which the same reference numerals for identical parts are used as in the first embodiment, a grooming ring 50 is integrally formed with terminal block 10, the grooming ring having two grooming ring portions 52 and 54. In this structure, the ring portion 52 is similar to the ring portion 34 of the first embodiment in that it lies in a single plane normal to the axial direction of the grooming space 56. However, the ring portion 54 while extending outwardly from the block in a plane normal to the axis, continues as a leg 58 which is inclined relative to the axis of the grooming space. This results in the leg 58 terminating at a free end 60 outwardly from the free end of the ring portion 52 with the free ends closely adjacent. In this structure, the leg 58 is flexed outwardly away from the block for insertion of conductor wires between the two ring portions. The inner surfaces of the two ring portions are free of obstruction from either one side or the other of the terminal block so that as described in the first embodiment, only two mold parts need be used to mold the complete assembly.

In a third embodiment as illustrated in FIGS. 13 to 17 inclusive, the carrier for the integrally molded grooming rings is not a terminal block as described in the previous embodiments, but is, instead, a fanning strip 61. The fanning strip 61 is provided by a narrow web 62 of material with integrally formed conductor fanning members 64 extending outwardly from a side 66 of the strip. At each end of the strip is provided a grooming ring 68 which is of similar construction to the grooming rings 14 described in the first embodiment. As will be realized, a two part mold may be used for molding the fanning strip with the grooming rings 68 in a manner similar to that described in the first embodiment for integrally molding the grooming rings onto the terminal block 12.

The fanning strip and a terminal block 70 (FIG. 16) have mutually engageable interlocking mounting means which enable the fanning strip with its grooming rings to be assembled onto the terminal block. This mounting means comprises two L-shaped projections 72 which extend from a surface of the fanning strip remote from the grooming rings, the projections 72 being slightly tapered as they extend upwardly of the strip in the views shown in FIGS. 13 and 15. The terminal block 70 is provided with two L-shaped slots 74, complementary in shape to the projections 72. These slots being formed upwardly from a lower surface of the terminal block 70, the slots terminating short of the upper surface of the block.

It follows that to assemble the fanning strip onto the terminal block 70 it is necessary to insert the strip onto the block by movement of the projections 72 upwardly into the slots 74 from the bottom surface of the block until the lower regions of the strip 61 are coplanar with the lower surface of the terminal block 70. In this mounted position, the assembly of block and fanning strip is then disposed within a terminal block housing and the terminal block is secured to a wall 76 of the housing as shown in FIG. 17. With the terminal block in this position, the fanning strip cannot be removed from the terminal block without removal of the block from the wall 76 of the housing. Thus, the projections 72 and slot 74 provide a simple method of assembling a fanning strip onto the terminal block without any requirement to use other fastening means such as screws or brackets.

What is claimed is:

1. An integrally molded grooming ring and grooming ring carrier in which the carrier has one side surface with a longitudinally extending axis and the grooming ring projecting from the carrier outwardly beyond said side surface and extends laterally of the side surface to define a grooming space having an axis extending longitudinally of the side surface, the grooming ring being resiliently flexible from a normal relaxed state to widen a gap for passage therethrough of conductors into the grooming space, and, in the normal relaxed state, the grooming ring being displaced axially of the side surface as it extends around the grooming space to enable all surfaces of the grooming ring, at any position along those surfaces, to be free of obstruction in at least one direction across the side surface and normal to its longitudinal axis.

2. An integrally molded grooming ring and grooming ring carrier according to claim 1 wherein the grooming ring comprises a single ring element which extends around and defines the grooming space while being displaced axially of the grooming space, the ring having a free end which in the normal relaxed state lies adjacent to the carrier, resilient flexing of the ring moving the free end of the ring to widen a gap between the free end and the carrier.

3. An integrally molded grooming ring and grooming ring carrier according to claim 1 wherein the carrier is a terminal block.

4. An integrally molded grooming ring and grooming ring carrier in which the carrier has one side surface with a longitudinally extending axis and a grooming ring projects from the carrier outwardly beyond said side surface and extends laterally of the side surface to define a grooming space having an axis extending longitudinally of the side surface, the grooming ring comprising two ring portions having ends integrally molded with the carrier and extending to free ends which, in a normal relaxed state of the ring portions, lie adjacent one another, the ring portions being resiliently movable by resilient flexing of at least one ring portion to widen a gap between their free ends for passage of conductors therebetween and into the ring and, in the normal relaxed state, the ring portions are displaced relative to one another axially of the side surface with all surfaces of the ring portions, at any position along those surfaces, being free of obstruction, in at least one direction across the side surface and normal to its longitudinal axis.

5. An integrally molded grooming ring and grooming ring carrier according to claim 4 wherein at least one ring portion extends axially of the ring as it extends towards its free end.

6. An integrally molded grooming ring and grooming ring carrier according to claim 3 wherein the carrier is a fanning strip having integrally molded conductor fanning members spaced apart longitudinally of the strip and axially of the grooming ring.

7. An integrally molded grooming ring and grooming ring carrier according to claim 6 wherein the fanning strip has a mounting means enabling the fanning strip to be assembled onto a terminal block.

8. A method of integrally molding a grooming ring and grooming ring carrier in which the carrier has a side surface with a longitudinally extending axis and the grooming ring projects from the carrier outwardly beyond said side surface while extending laterally of the side surface to define a grooming space having an axis extending longitudinally of the side surface, said method comprising:

moving mold parts together in opposite directions to define a mold cavity, the directional movement of the mold parts being laterally of the longitudinally extending axis;

integrally molding the grooming ring and carrier within the mold cavity with the grooming ring being displaced axially of the side surface as it extends around the grooming space with said mold parts defining all surfaces of the ring and also forming the grooming space; and opening the mold by moving the mold parts away from each other in a direction normal to the longitudinal axis of the side surface and transversely of the axis of the grooming space, all surfaces of the ring, at any position along those surfaces, being free of obstruction in at least one direction across the side surface and normal to its longitudinal axis.

* * * * *